United States Patent [19]

Gould

[11] 4,078,754

[45] Mar. 14, 1978

[54] FENCE POST SIGN HOLDER

[76] Inventor: George T. Gould, 1111 W. 141st St., S., Tulsa, Okla. 74033

[21] Appl. No.: 755,853

[22] Filed: Dec. 30, 1976

[51] Int. Cl.[2] ..... E04G 3/00

[52] U.S. Cl. ..... 248/218.4; 256/54; 403/313

[58] Field of Search ..... 248/218.4, 219.1, 222.1, 248/243, 222.3; 403/309, 313; 256/55, 54; 211/208, 207

[56] References Cited

U.S. PATENT DOCUMENTS

| | | | |
|---|---|---|---|
| 862,298 | 8/1907 | Webb | 256/55 |
| 1,915,479 | 6/1933 | Smith | 248/222.1 |
| 2,278,852 | 4/1942 | Hoffman | 248/218.4 |
| 2,447,228 | 8/1948 | Boston | 256/54 X |
| 2,833,575 | 5/1958 | Haller et al. | 403/313 |
| 3,731,429 | 5/1973 | Orthman | 248/218.4 |

*Primary Examiner*—Roy D. Frazier
*Assistant Examiner*—Peter A. Aschenbrenner
*Attorney, Agent, or Firm*—Head, Johnson & Chafin

[57] ABSTRACT

A bracket adapted to be installed on a metal fence post for securing a sign or other display material to the fence post without modification of the fence post, said bracket having a cross sectional configuration complementary to the cross sectional configuration defined by the outer limits of the fence post whereby said bracket substantially surrounds a portion of the post. The bracket is provided with slots for receiving the usual fence post lugs therein for securing the bracket to the fence post at substantially any desired height above the surface of the ground, and is provided with a substantially flat exposed surface for receiving the sign thereagainst in order that the sign may be secured thereto.

5 Claims, 8 Drawing Figures

FENCE POST SIGN HOLDER

BACKGROUND OF THE INVENTION

1. Field of the Invention

This invention relates to improvements in means for securing signs and the like to fence posts and more particularly, but not by way of limitation, to an improved means for securing signs to metallic fence posts without modification of the fence post itself.

2. Description of the Prior Art

Advertising sign boards, and the like, are frequently secured to the upright posts of barbed wire fences, and the like, for display purposes. The fence posts are usually constructed of metal and are normally of a substantially T-shaped cross sectional configuration. At the present time, it is difficult to secure the signs to the fence posts in that the cross sectional configuration of the post does not lend itself to receiving the sign thereagainst, and it is usually necessary to bore holes in the fence post, or otherwise modify the structure of the post in order to secure the sign or the like thereto. Since most of these fence posts are in remote locations, it is difficult to modify the metal posts because most manually operated cutting tools, or the like, are not sufficiently powerful for penetrating the metallic material of the fence post, and electricity, or the like, for operation of the usual power tool is not readily available. In addition, the owner of the fence may object to any modification of the fence posts.

SUMMARY OF THE INVENTION

The present invention contemplates a novel device for facilitating securing of a sign, or the like, to a metal post of a fence, such as a barbed wire fence, in a manner wherein no modification of the fence post is required. The device comprises a bracket having a pair of substantially flat sides disposed at planar angles with respect to one another, with the outer edge of each side being provided with an inwardly directed flange extending at a planar angle from its respective side. The first flat side of the bracket is provided with a plurality of slots of a size and spacing therebetween corresponding to the usual logs provided on the usual T-shaped metal fence post, said slots being provided for receiving the lugs therein. The flange member of the second flat side is provided with at least one aperture for receiving a suitable screw therethrough for engagement with the fence post in order to secure the bracket thereto. The second flat side receives the sign against the exposed surface thereof and is provided with apertures for receiving suitable screws therethrough for securing the sign to the bracket.

In order to install the bracket around the fence post, one of the flanges, preferably the flange of the first flat side, is placed against one of the arms of the Tee of the post, and the bracket is rotated about its longitudinal axis for moving the slots into alignment with the lugs. Further rotation of the bracket moves the slots over the lugs and "wraps" the bracket into a position around the outer confines of the post. A sheet metal screw, or the like, is then inserted through the aperture of the flange of the second flat side and is engaged with the post in order to securely retain the bracket in position thereon. In this manner, the outer face of the second flat side is exposed for receiving the sign thereagainst. The sign may be secured to the said second flat side by suitable sheet metal screws, or the like, as is well known. It will be readily apparent that in the event a relatively large sign is to be secured to the fence post or posts, one end of the sign may be secured to one bracket and the opposite end of the sign may be secured to a second bracket secured to the next successive fence post.

DESCRIPTION OF THE PREFERRED EMBODIMENT

Figure 1:
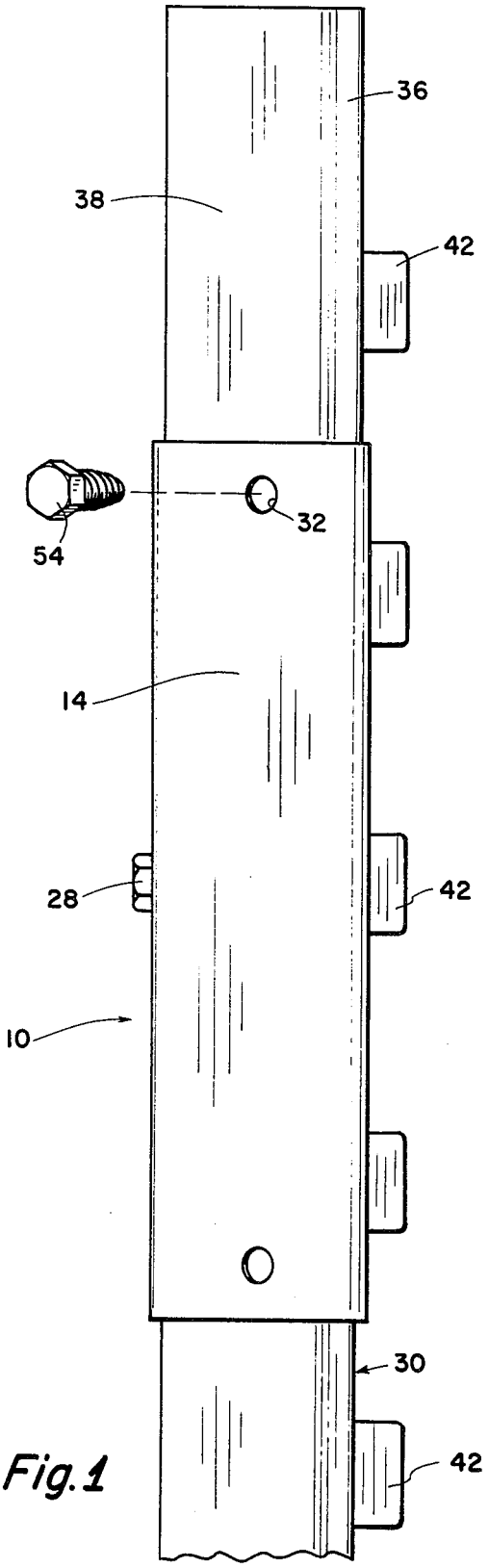
FIG. 1 is a broken side elevational view of a fence post having a fence post sign holder embodying the invention secured thereto.
Figure 2:
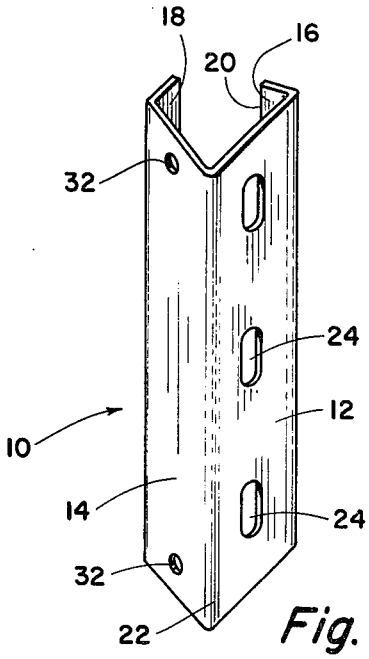
FIG. 2 is a perspective view of a fence post sign holder embodying the invention.

Referring to the drawings in detail, reference character 10 generally indicates a fence post sign holder or bracket comprising a first substantially flat side 12 and a second substantially flat side 14 conterminous therewith and disposed at a planar angle with respect thereto. A first flange 16 extends along the outer edge of the first flat side 12 and is angularly disposed with respect to the plane thereof. A second flange 18 similarly extends along the outer edge of the second flat side 14 and is angularly disposed with respect to the plane thereof. The flanges 16 and 18 extend generally in directions toward one another, and a hiatus 20 is provided between the flanges 16 and 18 substantially oppositely disposed with respect to the juncture 22 between the sides 12 and 14 for a purpose as will be hereinafter set forth.

A plurality of elongated substantially centrally disposed apertures 24 are longitudinally spaced on the flat side 12. At least one aperture 26 (FIGS. 4 through 8) is provided in the second flange 18 for receiving a metal screw 28, or the like, therethrough for removably securing the sign holder 10 to a fence post 30, as will be hereinafter set forth. In addition, the flat side 14 is preferably provided with at least two spaced aperatures 32 for facilitating securing of a sign (not shown) or the like thereto.

Figure 4:
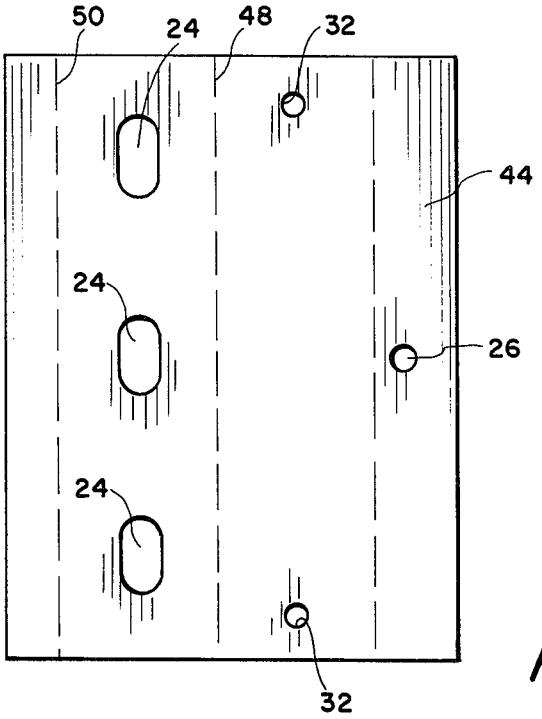
FIG. 4 is a plan view of a metal sheet which may be bent to form a fence post sign holder embodying the invention.

Although the bracket 10 may be constructed in any suitable manner, it is preferably formed from a flat sheet metal plate 44 as shown in FIG. 4. The slots 24 and apertures 26 and 32 may be punched or otherwise provided in the flat plate 44, and the plate 44 may be bent or folded in any suitable well known manner along the broken lines 48, 48 and 50 to form the two flat sides 12 and 14 and the two flanges 16 and 18. Of course, there is no intention of limiting the invention to this particular mode of construction.

Figure 3:
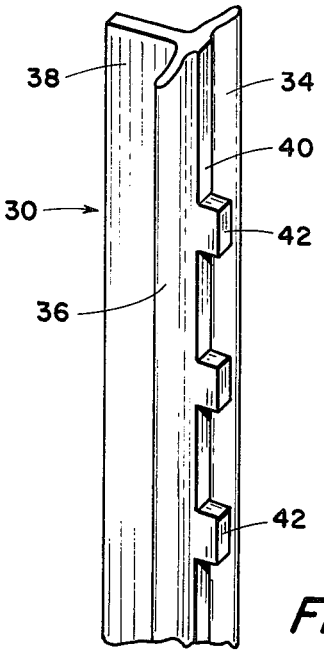
FIG. 3 is a broken perspecrive view of a fence post to which a fence post sign holder of the invention may be secured.

The fence post 30 as shown herein is of the usual or well known metallic type having a substantially T-shaped cross sectional configuration comprising a pair of oppositely disposed arms 34 and 36 extending outwardly from a central bar 38 at substantially right angles with respect thereto. A ridge 40 normally extends longitudinally throughout the length of the post 30 at the juncture between the arms 34 and 36 and is oppositely disposed from the bar 38, as particularly shown in FIG. 3. In addition, a plurality of outwardly extending lugs 42 are normally spaced along the ridge 40 for facilitating securing barbed wire (not shown) or the like to the post 30 during the erection of the usual barbed wire fence, as is well known.

Figure 5:
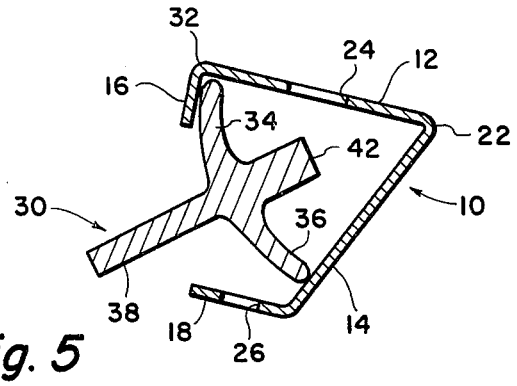
FIG. 5 is a sectional view of a fence post and illustrating the initial position of installation of a fence post sign holder embodying the invention thereon.
Figure 6:
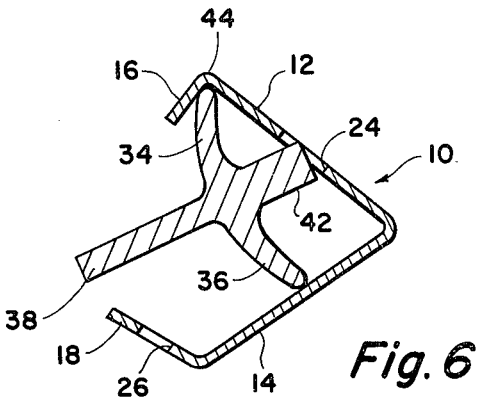
FIG. 6 is a view similar to FIG. 5 depicting a second position in the installation of a fence post sign holder on the fence post.
Figure 7:
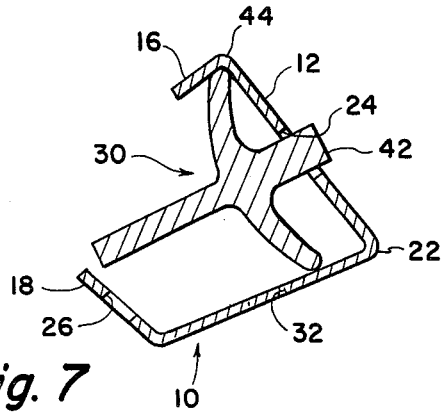
FIG. 7 is a view similar to FIGS. 5 and 6 illustrating a third position of installation of a fence post sign holder on the fence post.
Figure 8:
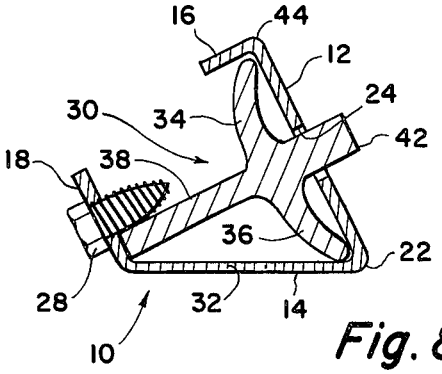
FIG. 8 is a view similar to FIGS. 5, 6 and 7 illustrating the final position for installation of a fence post sign holder on the fence post.

Referring now to FIGS. 5 through 8, in order to install the bracket 10 on the post 30, the bracket 10 is moved transversely with respect to the post 30 in such a manner that the hiatus 20 receives the arms 34 and 36 and the ridge 40 therethrough, and the flange 16 may be disposed against the left hand side of the arm 34 as shown in FIG. 5. The bracket 10 may then be manually rotated about its own longitudinal axis to the position shown in FIG. 6 wherein the slots 24 are moved to a position of substantial alignment with the lugs 42. The flange 16 pivots about the outer end of the arm 34 during the rotation of the bracket 10, and the tip of the arm 34 is brought into the proximity of the juncture between the side 12 and the flange 16. A continued rotation of the bracket 10 about its longitudinal axis moves the slots 24 over the lugs 42 as shown in FIG. 7. The bracket 10 is then furhter rotated about its longitudinal axis to bring the flange 18 into a position adjacent the outer edge of the bar 38 as shown in FIG. 8.

In this final position of the bracket 10 with respect to the post 30, the outer edge of the arm 34 will be positioned in the proximity of the juncture 52 between the side 12 and the flange 16, the outer edge of the arm 36 will be positioned in the proximity of the juncture 22 between the sides 12 and 14, and the outer edge of the bar 38 will be disposed against the inner surface of the flange 18, as shown in FIG. 8. The aperture 26 is disposed on the opposite side of the bar 38 from the juncture 22, and the sheet metal screw 28, or the like, may be inserted through the aperture 26 to provide a stop member against the side of the bar 38 for securely retaining the bracket 10 in position on the post 30. The engagement of the lugs 42 with the slots 24 retains the bracket 10 in the selected longitudinal position on the post 30 and the engagement of the screw 28 with the bar 38 retains the bracket 10 against rotation with respect to the post 30.

The side 14 is exposed for receiving a suitable sign (not shown) or the like thereagainst. The sign may be secured to the face or side 14 by inserting suitable sheet metal screws 54 (FIG. 1) or the like through the sign and through the apertures 32, as is well known.

From the foregoing it will be apparent that the present invention provides a novel fence post sign holder particularly designed and constructed for securing a display sign, or the like, to a metallic fence post in a manner precluding modification of the post itself. The novel sign holder comprises a bracket having a pair of substantiall flat sides having one contiguous edge and each of which is provided with an inwardly directed flange along the outer edge thereof. One flat side is provided with slots for engageing the lugs of the metal fence post for retaining the holder at substantially any desired height above the surface of the ground for the most advantageious displaying of the sign secured to the holder. The novel bracket is simple and efficient in operation and economical and durable in construction.

Whereas the present invention has been described in particular relation to the drawings attached hereto, it should be understood that other and further modifications, apart from those shown or suggested herein may be made within the spirit and scope of this invention.

What is claimed is:

1. Bracket means for securing a sign to a fence post having a substantially T-shaped cross sectional configuration including a longitudinal bar and oppositely extending arms and longitudinally spaced outwardly extending lugs interposed between the arms, said bracket comprising first and second substantially flat sides having one contiguous edge, said flat sides forming an acute angle therebetween, flange means integral with said flat sides and extending along the outer edges of said flat sides toward each other said bracket adjustably engages said post as said contiguous edge and one of the outer edges of one of said flat sides engage the edges of said oppositely extending arms of said post and the other said outer edge of said other flat side is drawn into engagement with the free edge of said longitudinal bar of said post by means cooperating with the flange means carried by the said outer edge of the flat side which engages the said longitudinal bar.

2. Bracket means as set forth in claim 1 wherein one of said flat sides is provided with aperture means for receiving said lugs therein to secured said bracket means in substantially any desired longitudinal position with respect to the fence post.

3. Bracket means as set forth in claim 2 wherein said flange means comprises a first flange member disposed along the outer edge of said one flat side, a second flange member disposed along the outer edge of the other flat side and having aperture means therein, said flange members extending generally in directions toward one another and leaving a hiatus there-between for receiving the fence post transversely therethrough.

4. Bracket means as set forth in claim 3 and including stop means extending through said aperture means and disposed substantially parallel with the plane of the longitudinal bar for engagement therewith to secure said bracket means to the fence post.

5. Bracket means as set forth in claim 4 wherein said other flat side is provided with aperture means for facilitating securing of a sign thereto.

* * * * *